US005730290A

United States Patent [19]

Futo

[11] Patent Number: 5,730,290

[45] Date of Patent: Mar. 24, 1998

[54] PACKAGED PLUNGER

[75] Inventor: Dennis M. Futo, Strongsville, Ohio

[73] Assignee: Waxman Consumer Products Group, Inc., Bedford Heights, Ohio

[21] Appl. No.: 786,453

[22] Filed: Jan. 13, 1997

[51] Int. Cl.[6] ..... B65D 73/00

[52] U.S. Cl. ..... 206/349; 206/223; 206/471; 206/518; 206/806

[58] Field of Search ..... 206/349, 361, 206/461, 462, 471, 223, 581, 515, 518, 519, 806, 497; 4/255.01, 255.04, 255.05, 255.11, 255.12

[56] References Cited

U.S. PATENT DOCUMENTS

| | | | |
|---|---|---|---|
| 4,199,060 | 4/1980 | Howard | 206/471 |
| 4,622,702 | 11/1986 | Allen | 4/255.12 |
| 4,637,516 | 1/1987 | De Roure | 206/471 |
| 4,702,368 | 10/1987 | Jones | 206/461 |
| 4,804,984 | 2/1989 | Heuer et al. | 206/461 |
| 5,114,006 | 5/1992 | Wilk . | |
| 5,307,930 | 5/1994 | Wilk et al. . | |
| 5,335,374 | 8/1994 | Wilk et al. . | |
| 5,456,356 | 10/1995 | Kurzawa | 206/349 |
| 5,499,561 | 3/1996 | Quinn | 206/349 |

FOREIGN PATENT DOCUMENTS

| | | |
|---|---|---|
| 1376871 | 10/1952 | Sweden . |

*Primary Examiner*—Paul T. Sewell
*Assistant Examiner*—Luan K. Bui
*Attorney, Agent, or Firm*—Vickers Daniels & Young

[57] ABSTRACT

A packaged plunger allows retailers to hang or stack plungers in a reduced and attractive space. The packaged plunger is sold disassembled on a merchandiser card with the plunger cup positioned over a hole allowing nesting and the plunger handle fixed to the card providing spacing about equal to the spacing provided by the nesting cups.

19 Claims, 4 Drawing Sheets

PACKAGED PLUNGER

BACKGROUND OF THE INVENTION

This application relates to plungers for use in clearing drain blockages and more particularly to a packaged plunger adapted to be stored and displayed by retailers advantageously.

Plungers are familiar objects to most persons as they are the first tool one normally uses on a blocked sink or toilet. Conventional plungers comprise a long, narrow handle resembling a broomstick and an elastomeric cup. The cup is flexible. The cup is normally from four to six inches in diameter. It has a concave underside with a flat lip around the bottom edge adapted to engage a sink bottom or the like. A recess is provided in the top of the cup holding the cup on the end of the handle. The handle is often two feet or longer in length. Plungers are sold in hardware stores and general merchandise stores where one expects to find plumbing repair supplies. Plungers are normally sold in the assembled state.

Retailing of plungers presents difficulties. The shape of a plunger makes them awkward to store and display. Because they are tall with a relatively narrow base, they can be unstable and easily tipped over. Therefore, they are often messy. They take up large amounts of floor space for each individual product. They cannot be conveniently stacked one on top of the other. They cannot be reasonably displayed on pegboards or the like. Application of the universal product code bar code identifiers is difficult. The handle has a small diameter making labeling difficult. The plunger cup is irregular in shape and often has mold release residue on its surfaces. Application of labels is difficult. Labels may fall off. When applied and retained, the position and curvature of the label makes reading by a bar code reader difficult. Plungers are basically awkward to present for retail sale, to store and to ship.

Additionally, conventional plungers have a broomstick-like rod handle. This rod-like handle is difficult for many people to use. In use one wishes to apply a quick forceful downstroke to the plunger to open a blocked drain. This is difficult when the only gripping surface is a rod of uniform diameter with its axis parallel to the direction in which one wishes to apply force.

Attempts have been made in the past to address the awkwardness of the plunger in the home. U.S. Pat. Nos. 5,114,006; 5,307,930; and, 5,335,374 all describe plungers having a handle arrangement and case for use in containing the plunger in the home. However, these products do not directly address retailing of plungers. Moreover, the plungers described all include parts in addition to a handle and a cup and will therefore increase the cost of the plunger.

Swedish patent 137,871 also describes an alternative plunger using a hollow handle and reversible cup.

None of these patents describe a structure which improves the ability to store, ship and merchandise conventional plungers satisfactorily.

OBJECT OF THE INVENTION

It is the principal object of the present invention to provide a packaged plunger which is easily shipped, stored and displayed for sale and also inexpensive to manufacture and package.

It is another object of the present invention to get plungers off the floor in retail stores and upon shelves and/or pegs for improved merchandising.

It is still another object of the present invention to provide a plunger having an improved handle more easily used by the consumer.

It is yet another object of the present invention to provide a packaged plunger which is easily stacked in a stable configuration for shipping, storage and display at retail.

It is still another object of the invention to provide a packaged plunger having a transparent front surface allowing a consumer to see the product.

SUMMARY OF THE INVENTION

A packaged plunger is provided in which the handle is separated from the cup and both are mounted on a merchandiser card with the cup being positioned over a hole in the merchandising card allowing the nesting of one packaged plunger on top of the other.

Further in accordance with the invention the handle and cup are both mounted to the front of the merchandising card by means of a form-fitting plastic sheet covering the front of the merchandising card.

Yet further in accordance with the invention, the handle of the plunger is provided with an enlarged end portion for grasping and the enlarged end portion is positioned on the merchandising card remote from the cup providing balanced spacing over the card.

Still further in accordance with the present invention, the hole in the merchandising card is sized to engage a nesting portion of the plunger cup and the nesting portion of the plunger cup is spaced from the bottom of the cup a distance approximately equal to the thickness of the enlarged handle whereby succeeding merchandising cards in a stack are generally parallel to one another.

Still further in accordance with the present invention, the end of the handle is ball shaped easing the use of the plunger by the consumer and providing required spacing for parallel stacking of the packaged plunger.

It is yet another object of the present invention to provide a packaged plunger which is easy to stack, store, ship and display for sale in a unitary, attractive package upon which trademarks, directions for use and universal product code information can be easily displayed and automatically read.

The invention may take physical form in certain parts and arrangements of parts, a preferred embodiment of which will be described in detail in this specification and illustrated in the accompanying drawings which form a part hereof and wherein.

Figure 1:
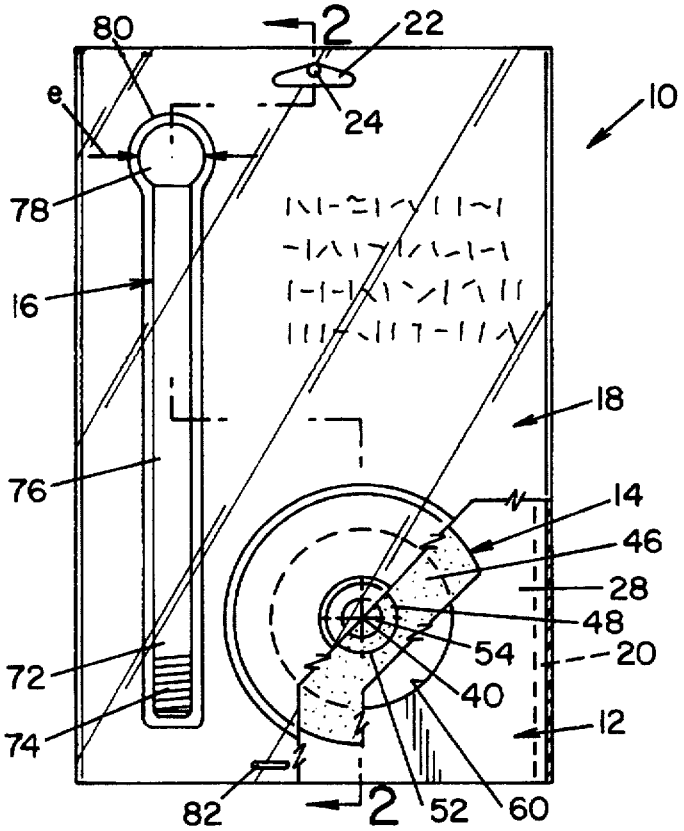
FIG. 1 is a plan view of the preferred embodiment of the packaged plunger of the present invention.

Referring now to the drawings wherein the showings are made for the purposes of illustrating preferred embodiments of the invention only and not for the purposes of limiting same, FIG. 1 shows a packaged plunger 10 comprising a merchandiser card 12, a plunger cup 14 and a plunger handle 16. The plunger cup 14 and the plunger handle 16 are held against the merchandiser card 12 by a transparent plastic film 18. The plastic film 18 may be a preformed film held to the card 12 by means of folded back portions 20 (FIG. 3) forming channels engaging the card 12; or, a shrink film applied to the front of the card 12 only and adhering to the front surface of the card. Either type of film results in positive placement of both the cup 14 and handle 16 and results in a unitary packaged product for display, shipping and storage.

The merchandiser card is also provided with a small hanging hole 22 for mounting the packaged plunger 10 on a conventional hook or peg 24 used in retailing. The front 28 of merchandiser card 12 is provided with a relatively large, flat, front-facing portion for the printing of trademarks and other promotional copy and graphics used in selling the product. The back 26 of the merchandiser card (FIG. 3) also has a large area for printing of directions 30, distributor identity 32 and UPC code 34. Other material as desired by the manufacturer or retailer can also be added.

The cup 14 is a unitary elastomeric part which is generally bell-shaped. Cup 14 has a central axis 40 (FIG. 2) and is generally symmetrical about this axis. The cup has a downwardly facing lower surface 42 which is concave and terminates in an annular outer lip 44. The cup 14 has an upper surface 46 generally parallel to the lower surface 42 over most of the height of the cup 14. The cup 14 also has a top barrel portion 48 with a substantially cylindrical outer wall 52 and a substantially cylindrical recess 54 opening to the top of the upper surface 46 and closed at its bottom. Threads 56 are provided on the side wall of the cylindrical recess 54.

Figure 2:
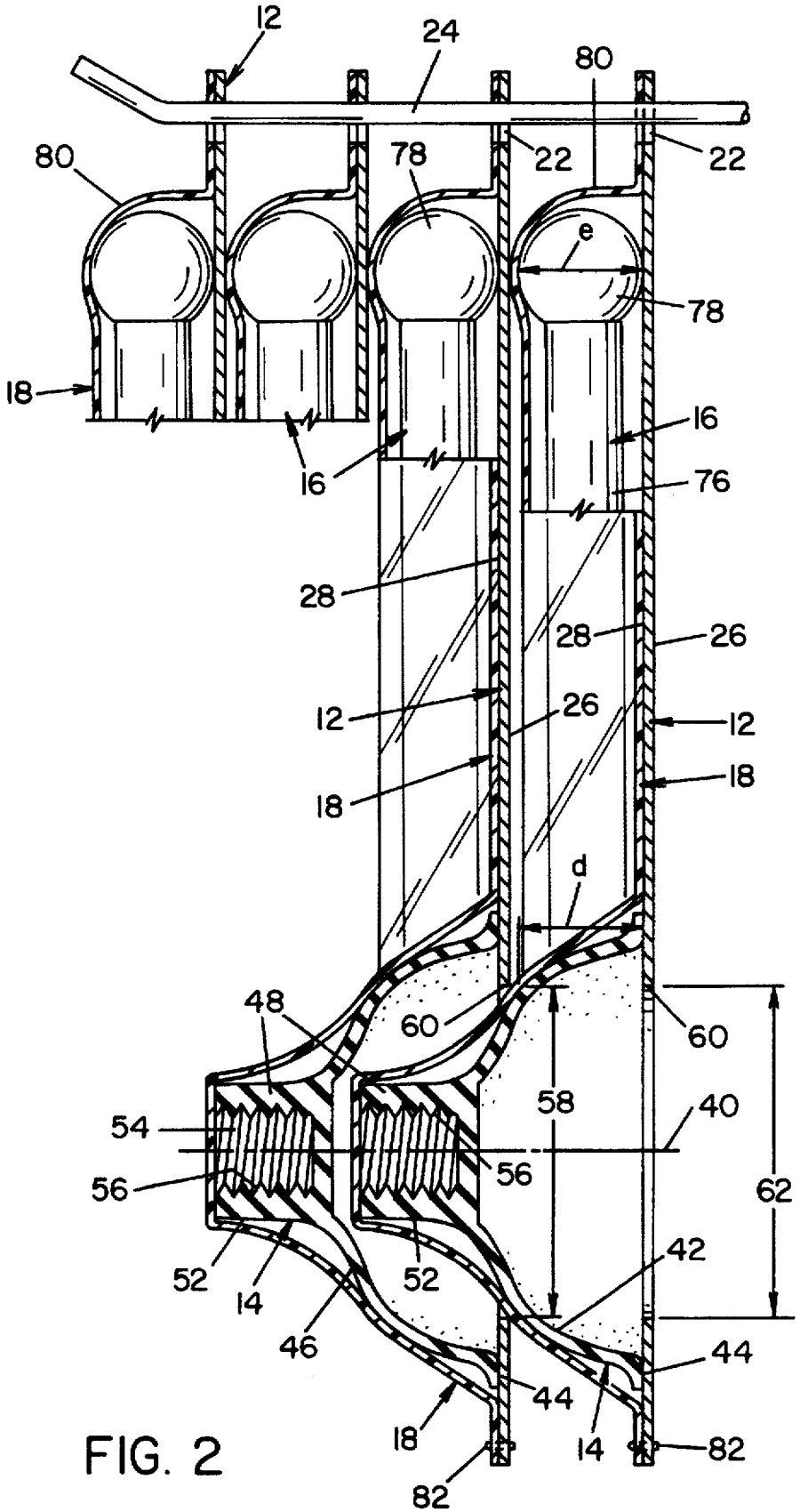
FIG. 2 is a cross-sectional side view of several of the packaged plungers seen in FIG. 1 as displayed upon a peg for merchandising taken on line 2—2 of FIG. 1.

As can be best seen in FIG. 2, the upper surface 46 of the cup 14 has a maximum diameter at or near its lowest extremity, the outer lip 44. The diameter of the upper surface 46 gradual tapers to a much smaller diameter and then maintains a constant or near constant smaller diameter over the length of the cylindrical outer wall 52 surrounding the cylindrical recess 54. The cylindrical outer wall 52 may be provided with a slight taper to ease molding.

At an axial position intermediate to the outer lip 44 and the cylindrical outer wall portion 52, the outer wall reaches a diameter identified herein as the nesting diameter 58. The nesting diameter 58 is positioned a selected axial distance "d" from the outer lip 44.

Figure 3:
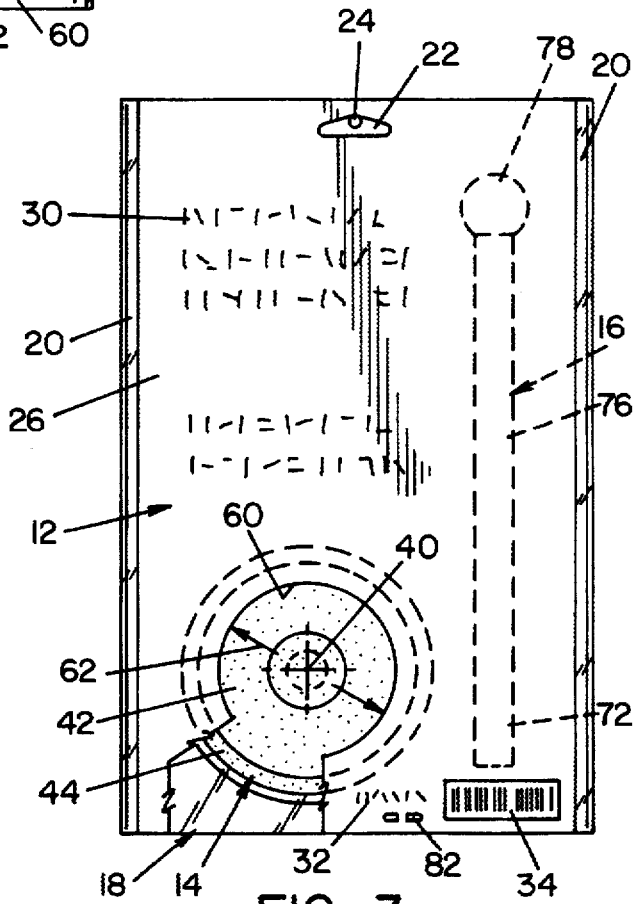
FIG. 3 is a back view of the packaged plunger of FIG. 1.

As can be seen in FIG. 3, the merchandiser card 12 is provided with a hole 60 with a hole diameter 62. The hole diameter 62 is selected to be equal to the nesting diameter 58 of the cup 14 increased by the thickness of the plastic film 18. Thus, when one packaged plunger 10 is stacked upon a second packaged plunger 10, the film covered cup of the lower plastic plunger will engage the hole 60 in the upper packaged plunger and support it such that the merchandiser card 12 of the upper packaged plunger will be a distance "d" increased by the thickness of the plastic film 18 above the merchandiser card 12 of the lower packaged plunger. Moreover, this support will not just be at a single point but will be along the entire periphery of the hole 60. The top portion of the lower cup 14 is received inside the cup resting on top of it. Space is saved.

The handle 16 is generally rod-shaped with a lower end 72 having threads 74 thereon. The handle has a long thin cylindrical intermediate rod section 76 and an enlarged upper end 78. The upper end 78 can be ball-shaped, as shown, or it can be oval in shape or take other shapes adapted to ease the use of the device in plunging. Importantly, the upper end 78 has a dimension usable as a spacer when packaged as a packaged plunger 10. With the ball shaped upper end 78 illustrated, the dimension is simply the diameter of the ball "e". The diameter "e" is selected so that the ball, when covered with the film 18, will provide a protrusion above the merchandiser card 12 substantially equal to the axial distance "d" increased by the thickness of the plastic film 18. Thus, when packaged plungers 10 are stacked one upon the other they will be supported around the periphery of the hole 60 and at the upper end of the handle 78 at the same distance. Successive merchandiser card can therefore be stacked in a parallel arrangement with good support. As can thus be seen in FIG. 1, support is provided at two of the opposite corners of the rectangular merchandiser card 12. A stable stacking is provided.

If the plastic film 18 is of the preformed type, a preformed protrusion 80 can surround the upper end 78 of the handle 16. Such a preformed protrusion 80 can be larger than the upper end 78 and extend completely across the merchandiser card to provide additional support. Moreover, such an arrangement can be used if one uses a completely rod-like handle 16 dispensing with the enlarged upper end of the handle 16. If one uses a heat shrunk plastic film, an enlarged upper end 78 of the handle is necessary to provide the proper spacing at the top of the merchandiser card 12. Such a handle top need not be ball shaped but could be oval or hand-grip shaped. Such an oval or grip shaped handle would have a dimension perpendicular to the card 12 approximately "e" to provide proper spacing of succeeding merchandiser cards in the stack.

The handle 16 can be turned out of the unitary piece of wood. Alternatively, and preferred, the handle 16 is a rod-like piece of wood having a separate ball 78 fixed to it at one end and threaded at the other. Further in the alternative, the handle 16 can be a two part telescoping handle with an integral or attached hand grip at the top. Such a telescoping handle allows one to provide a long handle for the consumer and a small package for the retailer.

Packaged plunger 10 of the present invention can be manufactured in a number of ways. One process is described below. The plunger cup 14 is injection molded or otherwise molded of an elastomeric material. It is a unitary part and is molded to the shape described above. The handle 16 is constructed from a wooden rod having threads at one end with a plastic ball 78 adhesively applied to the other end. The merchandiser card 12 is printed on one or both sides and the hole 60 die cut in the desired location. A cup 14 is placed upon the merchandiser card 12 set over the hole 60 in the lower right-hand corner of the merchandiser card 12. The handle 16 is placed upon the merchandiser card substantially parallel to the left-hand edge of the merchandiser card with the enlarged bowl-like upper end 78 positioned near the upper left-hand corner. A plastic film is then applied over the three elements and heat shrunk to the card holding all in the selected configuration. Alternatively, a preformed plastic film 18 having molded recesses and folded back portions 20 is used. The handle 16 and the cup 14 are placed in the recesses. The merchandiser card 12 is slipped under the folded back portions 20 and a staple 82 applied.

Figure 4:
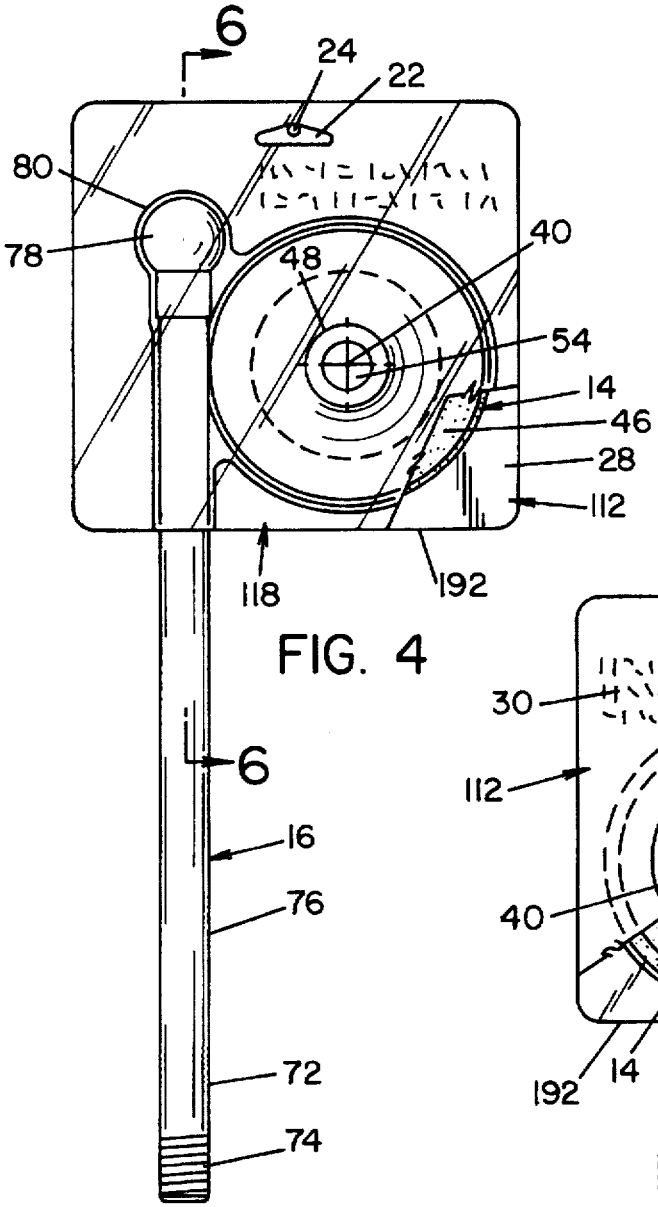
FIG. 4 is a front plan view of a second preferred embodiment of the invention using a smaller package.
Figure 5:
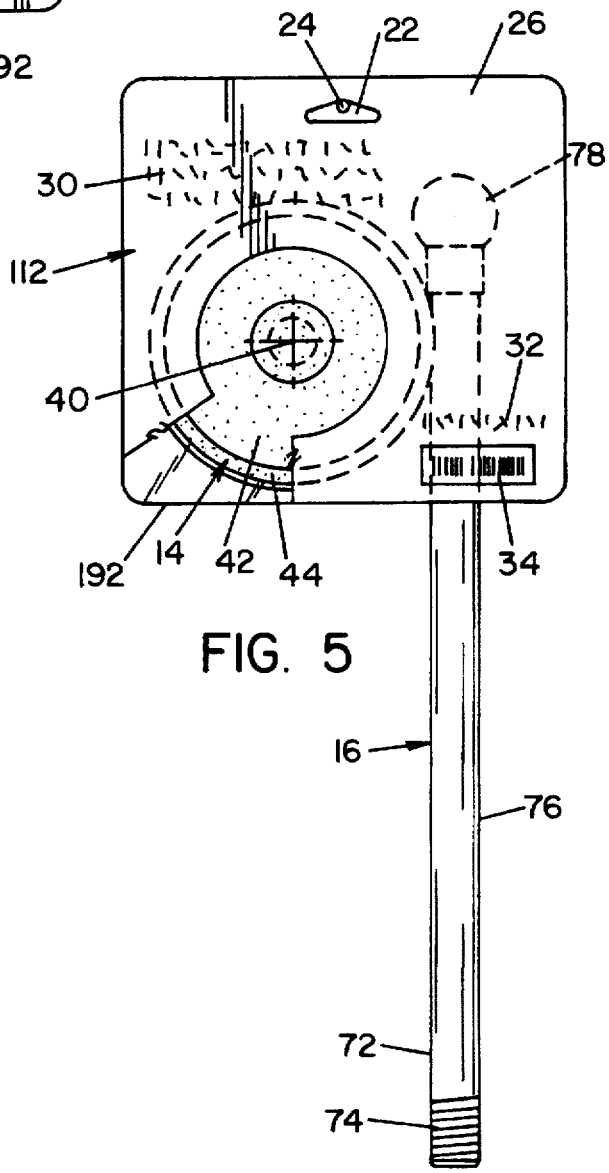
FIG. 5 is a rear plan view, partially cut away, of the embodiment of FIG. 4; and, FIG. 6 is a cross-sectional side view of the packaged plunger of FIG. 4 showing several such packaged plungers as displayed upon a peg for merchandising taken along line 6—6 of FIG. 4.
Figure 6:
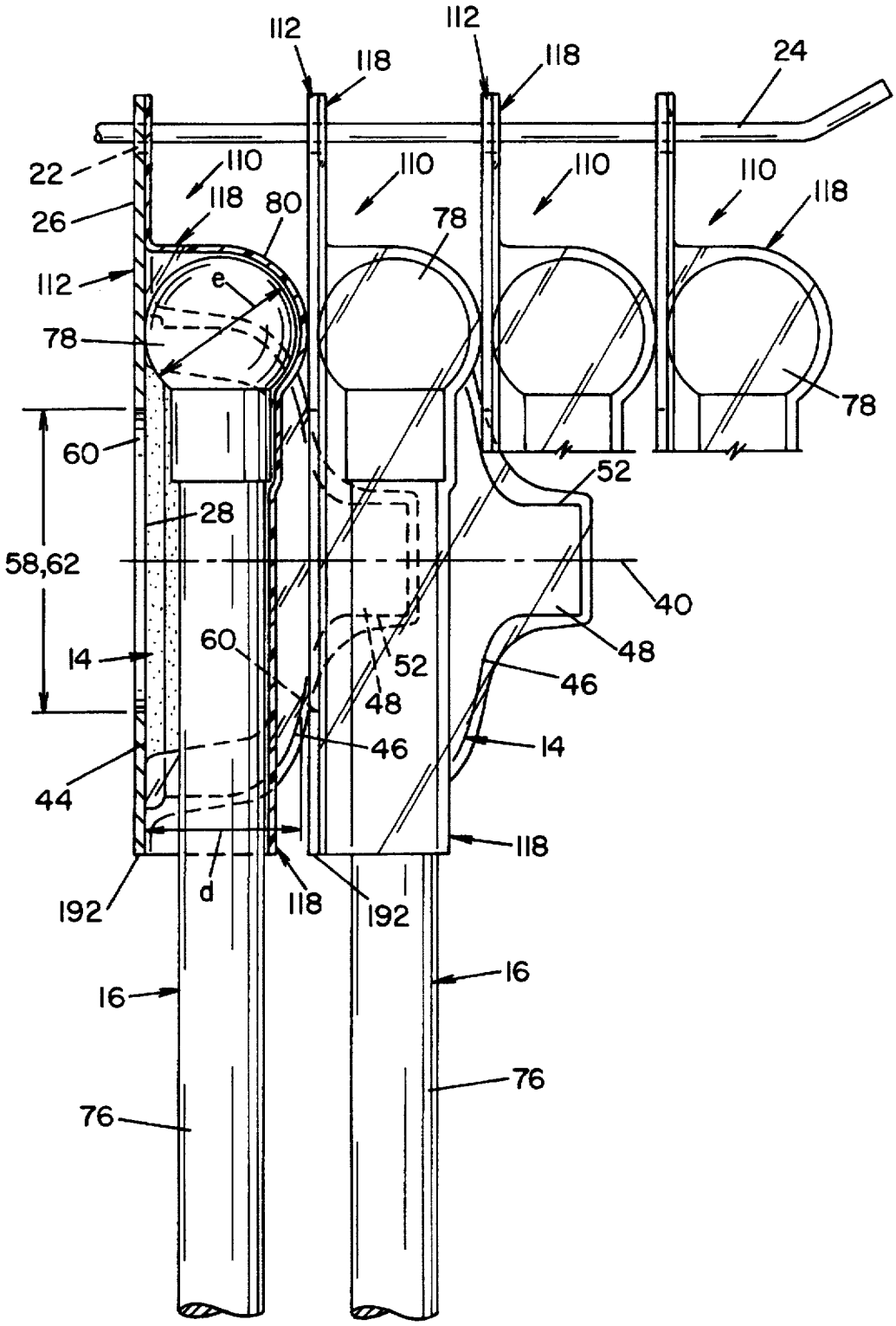

A second embodiment of the invention is shown in FIGS. 4, 5 and 6. The plunger cup 14 and the plunger handle 18 in the second embodiment are identical to the plunger cup 14 and the plunger handle 16 in the embodiment of FIGS. 1–3. Corresponding elements in FIGS. 4–6 bear the same reference numbers. The merchandiser card 112 of the second embodiment is significantly smaller than the merchandiser card of the first embodiment. As can be best seen in FIG. 4, the merchandiser card 112 is only large enough to accommodate plunger cup 14 and the top portion of the plunger handle 16. The lower end 72 of the plunger handle 16 is not contained on the merchandiser card 112. Rather, it extends well beyond the bottom 192 of the merchandiser card 112. The upper end 78 of the plunger handle 16 is positioned adjacent to the plunger cup 14 rather than significantly spaced from the plunger cup 14. As can be best seen in FIG. 6, this embodiment provides all the nesting advantages of the embodiments shown in FIGS. 1–3. As seen in FIG. 6, multiple packaged plungers 110 can be fixed on a peg 24 with plunger cup 14 of one packaged plunger 110 nesting in the hole 60 of the adjacent packaged plunger 110. An attractive compact display is provided. Moreover, this vertical stacking arrangement can be used for shipping multiple packaged plungers 110 in shipping boxes from manufacturers and distributors to retailers. The shipping box restrains the packaged plunger in this compact arrangement no matter what the orientation.

The first embodiment provides the advantage of stable, flat, unrestrained stacking. The second embodiment provides the advantage of economy in materials by using a smaller merchandiser card 112 and a smaller plastic film 118.

The invention has been described with reference to preferred embodiments. Obviously, modifications and alternations will occur to others upon the reading and understanding of this specification and it is intended to include such modifications and alterations insofar as they come within the scope of the appended claims or the equivalents thereof.

Having thus described the invention, it is claimed:

1. A packaged plunger comprising:

a handle having a threaded lower end and an enlarged upper end;

a cup having an axis of symmetry, a concave underside and a convex topside, said topside having a handle receiving recess adapted to engage said handle lower end, said cup having a top of a first diameter, a bottom of a second diameter and an intermediate nesting portion having a nesting diameter greater than said first diameter and less than said second diameter;

a merchandiser card having a hole having a hole diameter equal to or slightly larger than said nesting diameter; and, a plastic film fixing said cup to said card with said concave underside of said cup facing said card and surrounding said hole and said plastic film fixing said handle to said card disassembled from said cup with said upper end remote from said cup whereby multiple units of said packaged plunger may be arranged with said cups nesting in one another through said holes.

2. The packaged plunger of claim 1 wherein said enlarged upper end has a first dimension perpendicular to said card approximately equal to the axial distance between said cup bottom and said cup nesting portion.

3. The packaged plunger of claim 2 wherein said plastic film is heat shrunk to the front of said card.

4. The packaged plunger of claim 2 wherein said plastic film is preformed with recesses accommodating said cup and said handle.

5. A packaged plunger comprising:

a handle;

a cup having a concave underside and a convex topside, said topside having a handle receiving recess adapted to engage said handle;

a merchandiser card having a hole; and, said cup being fixed to said card with said concave underside facing said card and surrounding said hole and said handle being fixed to said card disassembled from said cup whereby multiple units of said packaged plunger may be arranged with said cups nesting in one another through said holes.

6. The packaged plunger of claim 5 wherein said merchandiser card has a front side and a back side; and, said cup and said handle are fixed to said front side by a plastic sheet.

7. The packaged plunger of claim 6 wherein said handle comprises a shaft, a first end adapted to engage said cup and a second end adapted to be grasped by a user when operating the assembled plunger; said second end being enlarged when compared to said shaft, said second end being positioned on said merchandiser card remote from said cup.

8. The packaged plunger of claim 7 wherein said merchandiser card hole has a hole diameter; and, said cup has an axis and is generally symmetrical about said axis, said cup having a top of a first diameter less than said hole diameter containing said handle recess; said cup having a bottom of a second diameter larger than said first diameter and a nesting portion intermediate said top and bottom having a third diameter approximately equal to said hole diameter, said nesting portion being axially spaced from said bottom a distance approximately equal to the thickness of said handle second end.

9. The packaged plunger of claim 8 wherein said handle second end is ball shaped.

10. The packaged plunger of claim 9 wherein said handle first end is threaded and said cup recess is threaded.

11. The packaged plunger of claim 6 wherein said plastic sheet has a protrusion of a first height and said hole and said cup cooperate to allow nesting of adjacent cups to a depth allowing the spacing of adjacent cups to be equal to said first height such that said packaged plunger may be stacked or hung with said merchandiser cards generally parallel.

12. A packaged plunger comprising:

a handle having a threaded lower end and an enlarged upper end;

a cup having an axis of symmetry, a concave underside and a convex topside, said topside having a handle receiving recess adapted to engage said handle lower end, said cup having a top of a first diameter, a bottom of a second diameter and an intermediate nesting portion having a nesting diameter greater than said first diameter and less than said second diameter;

a merchandiser card having a hole having a hole diameter equal to or slightly larger than said nesting diameter; and, a plastic film fixing said cup to said card with said concave underside of said cup facing said card and surrounding said hole and said plastic film fixing said handle to said card disassembled from said cup whereby multiple units of said packaged plunger may be arranged with said cups nesting in one another through said holes.

13. The packaged plunger of claim 12 wherein said enlarged upper end has a first dimension perpendicular to said card approximately equal to the axial distance between said cup bottom and said cup nesting portion.

14. The packaged plunger of claim 13 wherein said plastic film is heat shrunk to the front of said card.

15. The packaged plunger of claim 12 wherein said plastic film is preformed with recesses accommodating said cup and said handle.

16. A packaged plunger comprising:

a cup having a concave underside and a convex topside, said topside having a handle receiving recess;

a merchandiser card having a hole;

a handle comprising a shaft, a first end adapted to engage said recess of said cup and a second end adapted to be grasped by a user when operating the assembled plunger; said second end being enlarged when compared to said shaft, said second end being positioned on said merchandiser card; and, said cup being fixed to said card with said concave underside facing said card and surrounding said hole and said handle being fixed to said card disassembled from said cup whereby multiple units of said packaged plunger may be arranged with said cups nesting in one another through said holes.

17. The packaged plunger of claim 16 wherein said merchandiser card has a front side and a back side; and, said cup and said handle second end are fixed to said front side by a plastic sheet.

18. The packaged plunger of claim 17 wherein said merchandiser card hole has a hole diameter; and, said cup has an axis and is generally symmetrical about said axis, said cup having a top of a first diameter less than said hole diameter containing said handle recess; said cup having a bottom of a second diameter larger than said first diameter and a nesting portion intermediate said top and bottom having a third diameter approximately equal to said hole diameter, said nesting portion being axially spaced from said bottom a distance approximately equal to the thickness of said handle second end.

19. The packaged plunger of claim 18 wherein said handle second end is ball shaped and said handle extends beyond said merchandiser card whereby a card having a dimension less long than said handle may be used.

* * * * *